US008099017B2

(12) United States Patent
Takemoto

(10) Patent No.: US 8,099,017 B2
(45) Date of Patent: Jan. 17, 2012

(54) FRAME STRUCTURE AND IMAGE FORMING APPARATUS

(75) Inventor: Hideyuki Takemoto, Chigasaki (JP)

(73) Assignee: Ricoh Company Ltd., Tokyo (JP)

( * ) Notice: Subject to any disclaimer, the term of this patent is extended or adjusted under 35 U.S.C. 154(b) by 464 days.

(21) Appl. No.: 12/379,747

(22) Filed: Feb. 27, 2009

(65) Prior Publication Data

US 2009/0218472 A1 Sep. 3, 2009

(30) Foreign Application Priority Data

Feb. 28, 2008 (JP) ..... 2008-048353

(51) Int. Cl.
*G03G 15/00* (2006.01)

(52) U.S. Cl. ..... 399/107

(58) Field of Classification Search ..... 248/542; 399/107, 126, 110, 118, 117
See application file for complete search history.

(56) References Cited

U.S. PATENT DOCUMENTS

| | | | |
|---|---|---|---|
| 5,949,924 | A | 9/1999 | Noguchi et al. |
| 6,023,538 | A | 2/2000 | Noguchi et al. |
| 6,078,703 | A | 6/2000 | Noguchi et al. |
| 6,122,412 | A | 9/2000 | Noguchi et al. |
| 6,546,228 | B2 | 4/2003 | Motohashi et al. |
| 6,690,901 | B2 | 2/2004 | Katsuyama et al. |
| 7,177,573 | B2 | 2/2004 | Kimura et al. |
| 7,302,204 | B2 | 11/2007 | Katsuyama et al. |
| 2002/0150403 | A1 | 10/2002 | Katsuyama et al. |
| 2004/0114958 | A1 | 6/2004 | Katsuyama et al. |
| 2004/0234296 | A1 | 11/2004 | Kimura et al. |
| 2005/0200674 | A1 * | 9/2005 | Mae et al. ..... 347/101 |
| 2007/0195212 | A1 * | 8/2007 | Endo et al. ..... 349/5 |
| 2008/0240781 | A1 * | 10/2008 | Murano ..... 399/122 |

FOREIGN PATENT DOCUMENTS

| | | |
|---|---|---|
| CN | 2502436 | 7/2002 |
| JP | 2001-228666 | 8/2001 |
| JP | 2003-280307 | 10/2003 |
| JP | 2007-135243 | 5/2007 |
| JP | 2007-328204 | 12/2007 |

OTHER PUBLICATIONS

Machine Translation of JP 2007-328204, Dec. 2007.*
Extended European Search Report dated Sep. 14, 2009 issued in corresponding Application No. EP 09250430.
Office Action dated Aug. 3, 2010 issued in corresponding Chinese Application No. 2009100042732.

* cited by examiner

*Primary Examiner* — Susan Lee
(74) *Attorney, Agent, or Firm* — Harness, Dickey & Pierce, P.L.C.

(57) ABSTRACT

A frame structure includes three or more supporting members, a scanner support, a scanner cantilever support, and an adjuster. Three or more supporting members are provided vertically from a base portion. The scanner support is provided horizontally between upper portions of the supporting members. The scanner cantilever support extends horizontally from the upper portion of one of the supporting members. The adjuster is attached to a free end of the cantilever support, and includes an inclined slot. The cantilever support includes a protrusion provided in the free end of the scanner cantilever support. The protrusion is engageable with the slot of the adjuster to obliquely raise and lower the adjuster.

13 Claims, 7 Drawing Sheets

FRAME STRUCTURE AND IMAGE FORMING APPARATUS

PRIORITY STATEMENT

The present patent application claims priority from Japanese Patent Application No. 2008-048353, filed on Feb. 28, 2008 in the Japan Patent Office, the entire contents of which are hereby incorporated herein by reference.

BACKGROUND OF THE INVENTION

1. Field of the Invention

Example embodiments generally relate to a frame structure and an image forming apparatus including the frame structure, for example, in which the frame structure has a compact structure that efficiently supports a scanner.

2. Description of the Related Art

Image forming apparatuses, such as copiers, facsimile machines, printers, and multifunction devices having at least one of copying, printing, scanning, and facsimile functions, typically form a toner image on a recording medium (e.g., a sheet) based on image data using electrophotography.

When an image forming device forms a toner image on a sheet conveyed from a feeding device, the sheet bearing the toner image is discharged to the outside of the image forming apparatus.

Recently, internal-discharge-type image forming apparatuses are provided. The internal-discharge-type image forming apparatuses include a discharge space provided inside an area defined by the body of the image forming apparatus. In order to facilitate removal of a discharged sheet, such discharge space is typically open at a front side and one lateral side of the image forming apparatus.

However, given that the discharge space opens at the front side and one lateral side of the image forming apparatus, it is apparent that a scanner provided above the discharge space is supported at only three points instead of a more stable arrangement in which the scanner is supported at four points. Thus, for example, when a user accidentally puts their weight on the scanner or otherwise imposes an excessive downward load on the scanner, an adjuster that is typically provided for adjusting a horizontal position of the scanner is displaced from an original position or damaged. As a result, the scanner fails to maintain a horizontal position, resulting in faulty scanning.

In addition, when the adjuster is damaged, the adjuster needs to be adjusted or replaced by a new one, which increases cost and down time. Therefore, the rate of utilization of the image forming apparatus decreases, while its running cost and maintenance cost increase.

Accordingly, there is a need for a technology capable of preventing the adjuster from being displaced as described above in order to prevent faulty image scanning.

SUMMARY

At least one embodiment provides a frame structure that includes three or more supporting members, a scanner support, a scanner cantilever support, and an adjuster. Three or more supporting members are provided vertically from a base portion. The scanner support is provided horizontally between upper portions of the supporting members. The scanner cantilever support extends horizontally from the upper portion of one of the supporting members. The adjuster is attached to a free end of the cantilever support, and includes an inclined slot. The cantilever support includes a protrusion provided in the free end of the scanner cantilever support. The protrusion is engageable with the slot of the adjuster to obliquely raise and lower the adjuster.

Further, at least one embodiment provides a frame structure that includes three or more supporting members, a scanner support, a scanner cantilever support, and an adjuster. Three or more supporting members are provided vertically from a base portion. The scanner support is provided horizontally between upper portions of the supporting members. The scanner cantilever support extends horizontally from the upper portion of one of the supporting members, and includes an inclined slot. The adjuster is attached to a free end of the cantilever support, and includes a protrusion engageable with the slot of the cantilever support to obliquely raise and lower the adjuster.

At least one embodiment provides an image forming apparatus that includes a frame structure. The frame structure includes three or more supporting members, a scanner support, a scanner cantilever support, and an adjuster as described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
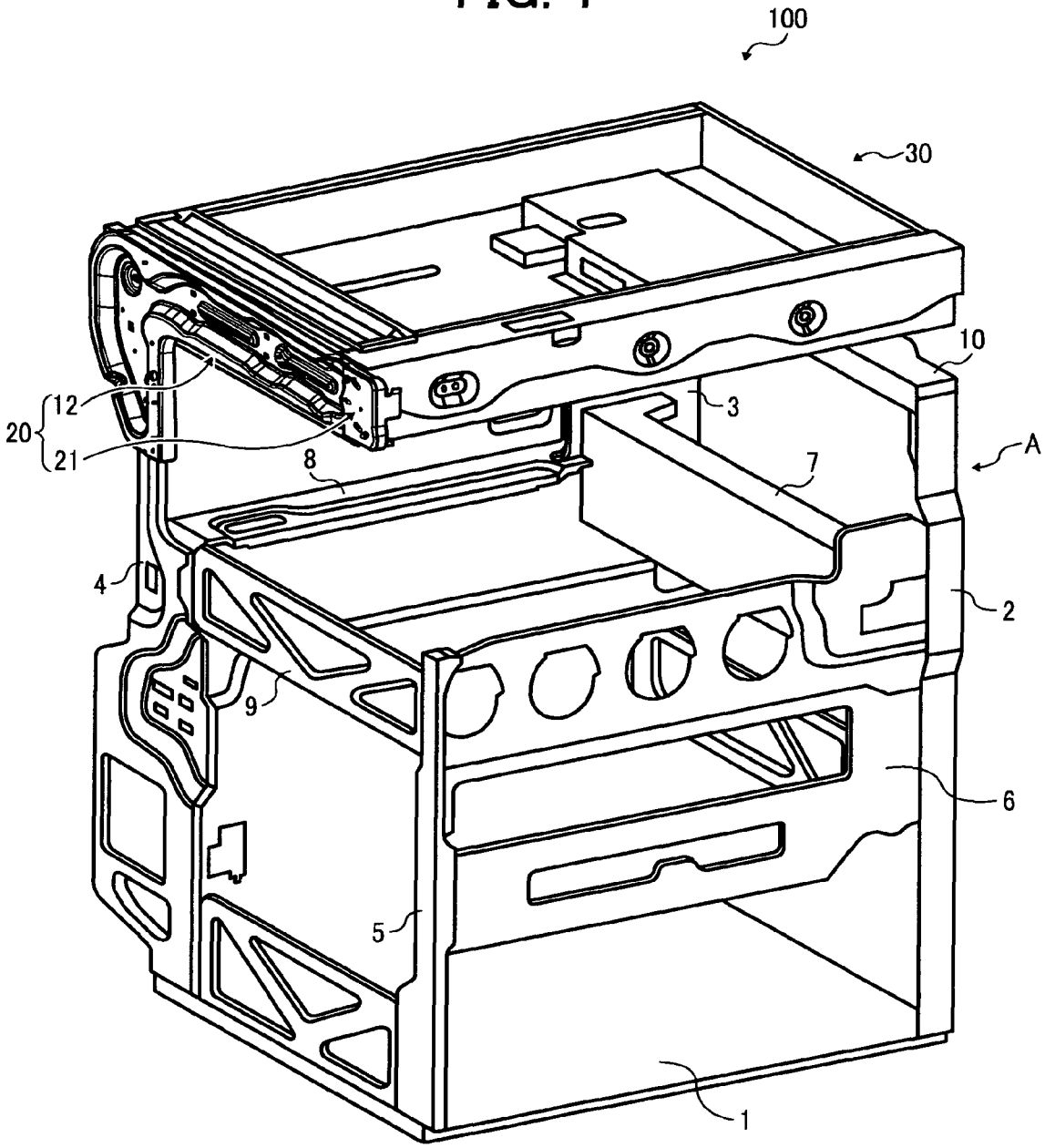
FIG. 1 is a schematic perspective view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar-manner and achieve a similar result.

Figure 2:
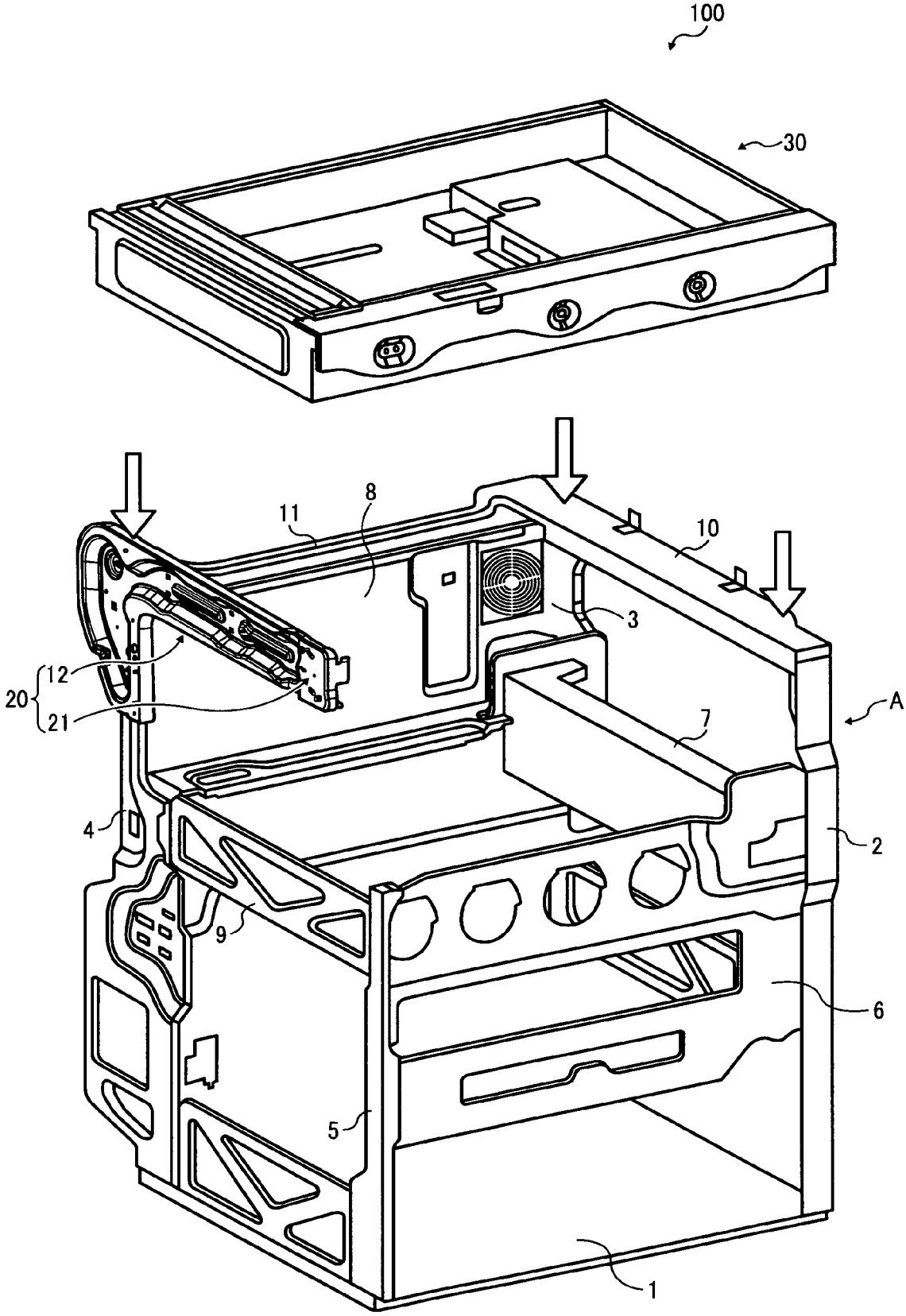
FIG. 2 is a second perspective view of the image forming apparatus shown in FIG. 1, with a scanner of the image forming apparatus separated from a frame structure of the image forming apparatus.

Referring now to the drawings, wherein like reference numerals designate identical or corresponding parts throughout the several views thereof, in particular to FIGS. 1 and 2, the structure of an image forming apparatus 100 according to an example embodiment of the present invention is described.

FIG. 1 is a schematic perspective view of the image forming apparatus 100, which in this embodiment is an internal-discharge-type image forming apparatus. The image forming apparatus 100 includes a frame structure A and/or a scanner 30. FIG. 2 is a second perspective view of the image forming apparatus 100 with the scanner 30 separated from the frame structure A. As illustrated in FIGS. 1 and 2, the frame structure A includes a base frame 1, corner columns 2, 3, 4, and 5, side plates 6, 7, 8, and 9, scanner supports 10 and 11, and/or a scanner positioning mechanism 20. The scanner positioning mechanism 20 includes a scanner cantilever support 12 and/or an adjuster 21.

The columns 2, 3, 4, and 5 extend vertically from corners of the base frame 1, respectively. The side plates 6, 7, 8, and 9 are provided between the columns 2, 3, 4, and 5. The columns 2, 3, and 4, serving as supporting members, are longer than the column 5. The scanner supports 10 and 11 are provided horizontally above the long columns 2, 3, and 4 and fixed to the side plates 7 and 8, respectively, to support a bottom of the scanner 30.

The scanner cantilever support 12 protrudes horizontally from a top edge of the column 4 toward the short column 5.

The scanner supports 10 and 11, and the scanner cantilever support 12, support the scanner 30.

In order to facilitate removal of a discharged sheet, the frame structure A of the internal-discharge-type image forming apparatus 100 defines an internal discharge space, open at a front side and one lateral side of the frame structure A, as illustrated in FIG. 1. Accordingly, the scanner 30 is supported at three points, that is, the columns 2, 3, and 4, serving as supporting members.

Figure 3:
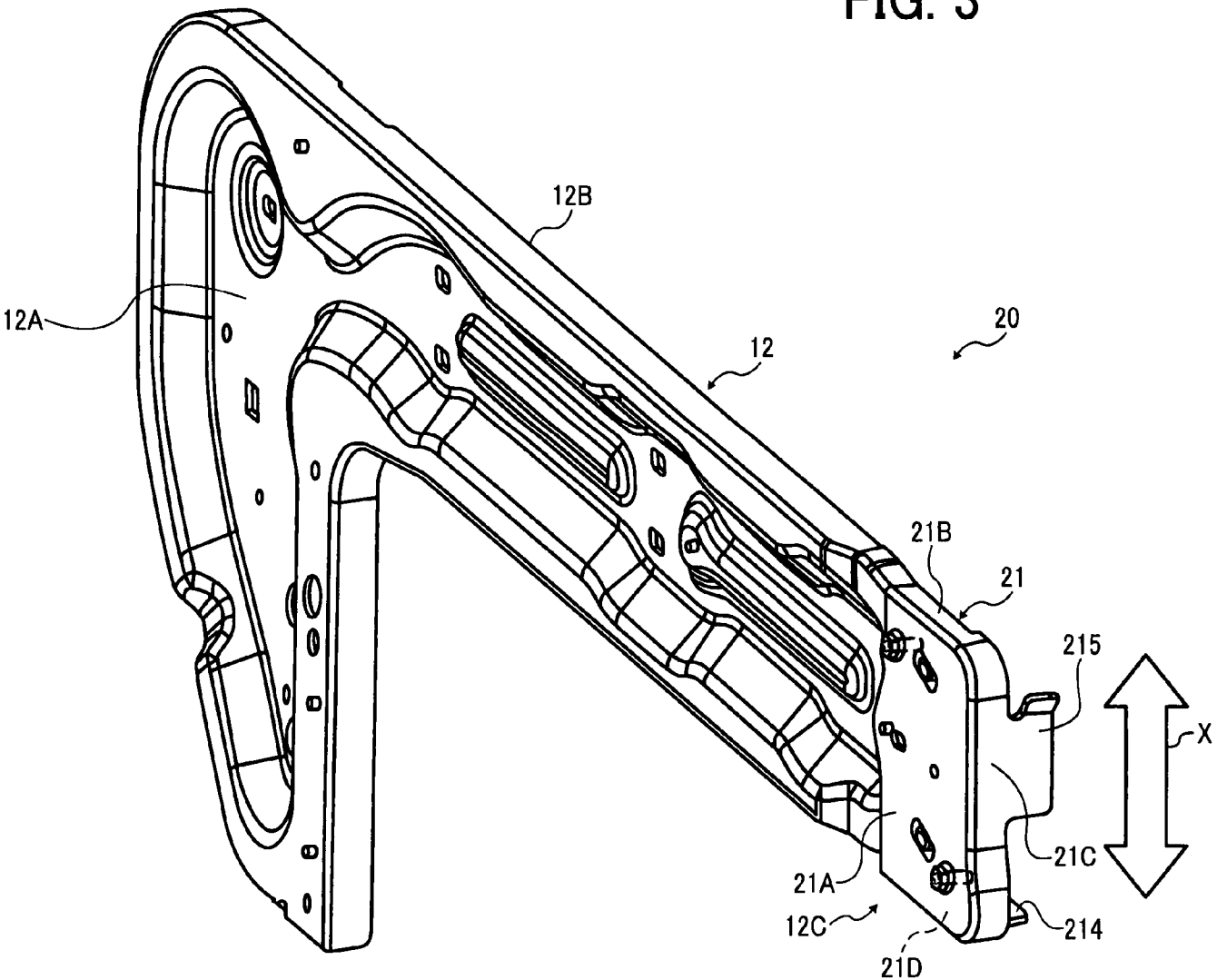
FIG. 3 is a perspective view of a scanner adjustment mechanism included in the image forming apparatus shown in FIG. 2.
Figure 4:
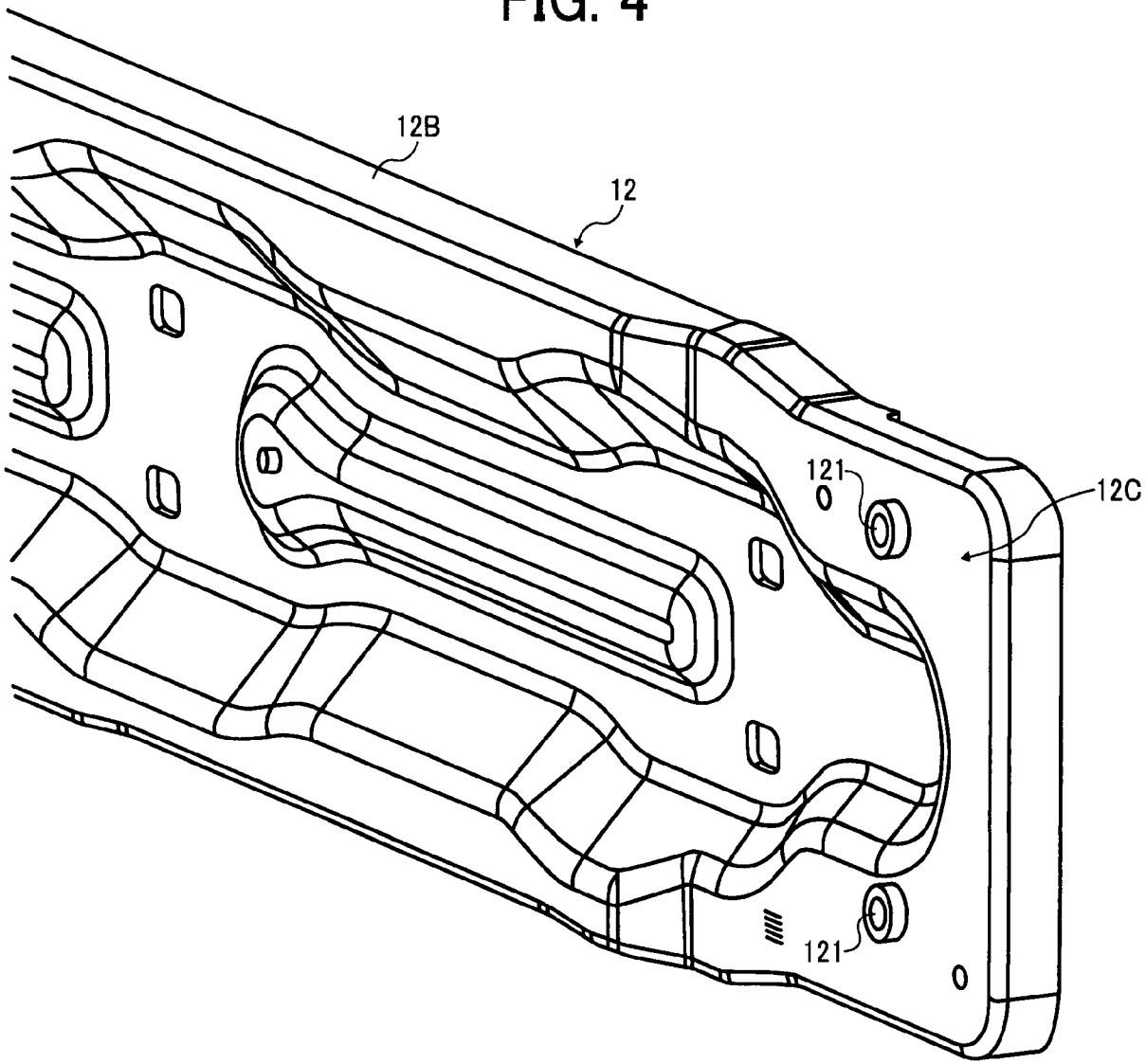
FIG. 4 is a partial view of a scanner cantilever included in the scanner adjustment mechanism shown in FIG. 3.
Figure 5:
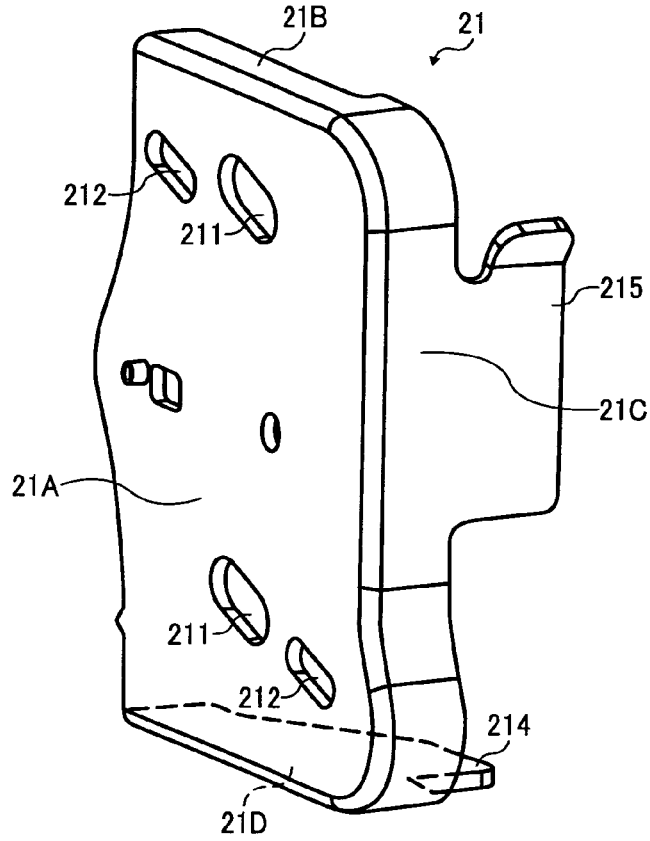
FIG. 5 is a perspective view of an adjuster included in the scanner adjustment mechanism shown in FIG. 3.

Referring to FIGS. 3, 4, and 5, a description is now given of a structure of the scanner positioning mechanism 20. FIG. 3 is a perspective view of the scanner positioning mechanism 20. FIG. 4 is a partial view of the scanner cantilever support 12 of the scanner positioning mechanism 20. FIG. 5 is a perspective view of the adjuster 21.

As illustrated in FIG. 3, the scanner cantilever support 12 includes a fixed end portion 12A, a support body 12B, and/or an adjuster supporting portion 12C. The adjuster 21 includes a plate-like portion 21A, rims 21B, 21C, and 21D, a scanner mount 214, and/or a scanner positioner 215. As illustrated in FIG. 4, the adjuster supporting portion 12C includes two protrusions 121. As illustrated in FIG. 5, the plate-like portion 21A includes a first slot 211 and/or a second slot 212.

The adjuster 21 is fixed to a free end portion of the scanner cantilever support 12, and adjusts a horizontal position of the scanner 30 in directions indicated by the double-headed arrow X as illustrated in FIG. 3.

As illustrated in FIG. 3, the cantilever support 12 is substantially L-shaped. The fixed end portion 12A is provided in a base portion of the scanner cantilever support 12 to be fixed to an upper portion of the column 4, as illustrated in FIG. 2. The support body 12B extends horizontally from the fixed end portion 12A. The adjuster supporting portion 12C is provided at the opposite end of the support body 12B, away from the fixed end portion 12A. As illustrated in FIG. 4, the protrusions 121 protrude from an outer surface of the adjuster supporting portion 12C, and are disposed vertically along the adjuster supporting portion 12C.

As illustrated in FIG. 3, the plate-like portion 21A covers an outer surface of the adjuster supporting portion 12C of the scanner cantilever support 12. The rims 21B, 21C, and 21D are provided along three sides of the plate-like portion 21A, and include a curved portion.

Figure 6:
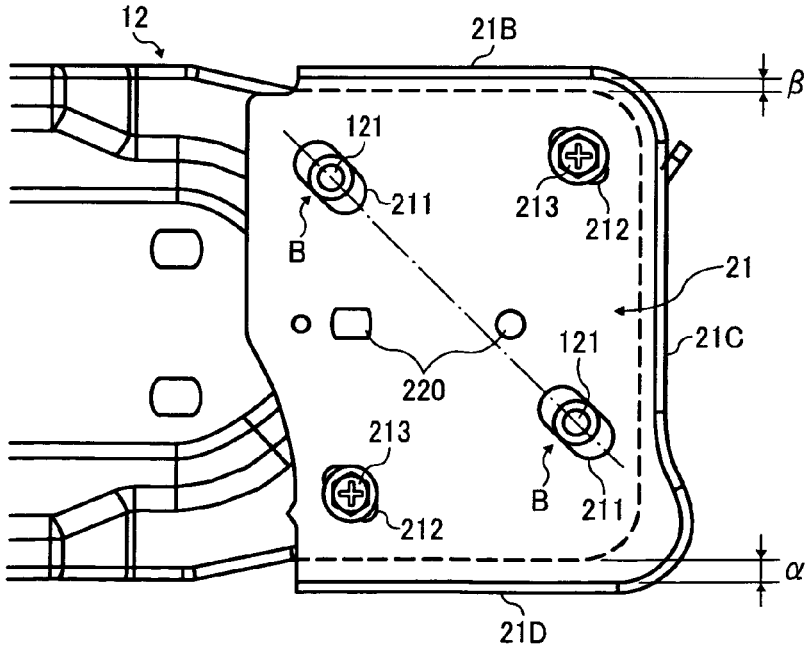
FIG. 6 is a schematic front view of the adjuster and the cantilever support shown in FIG. 3.
Figure 7:
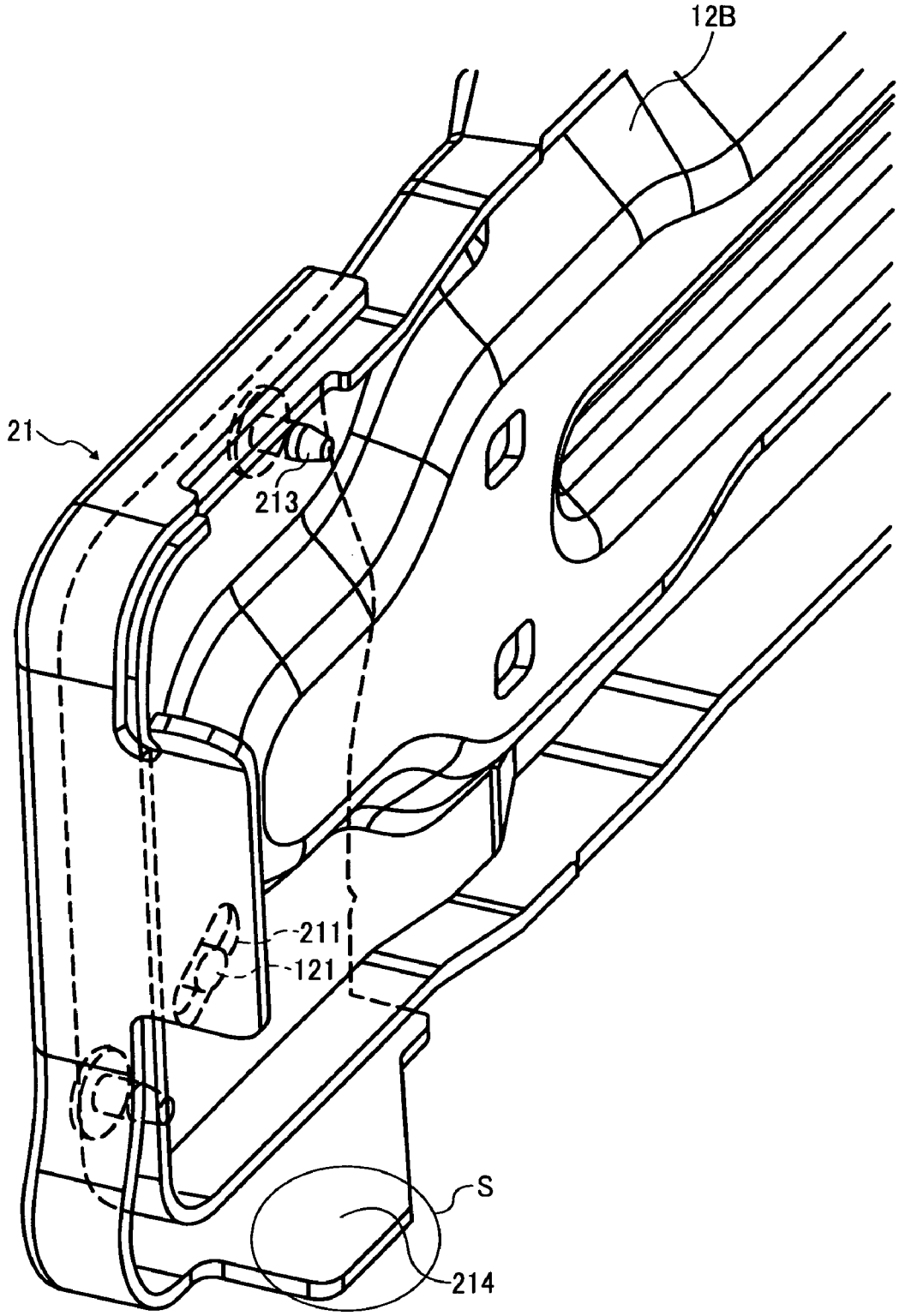
FIG. 7 is a perspective view of the adjuster and the cantilever support shown in FIG. 6.
Figure 8:
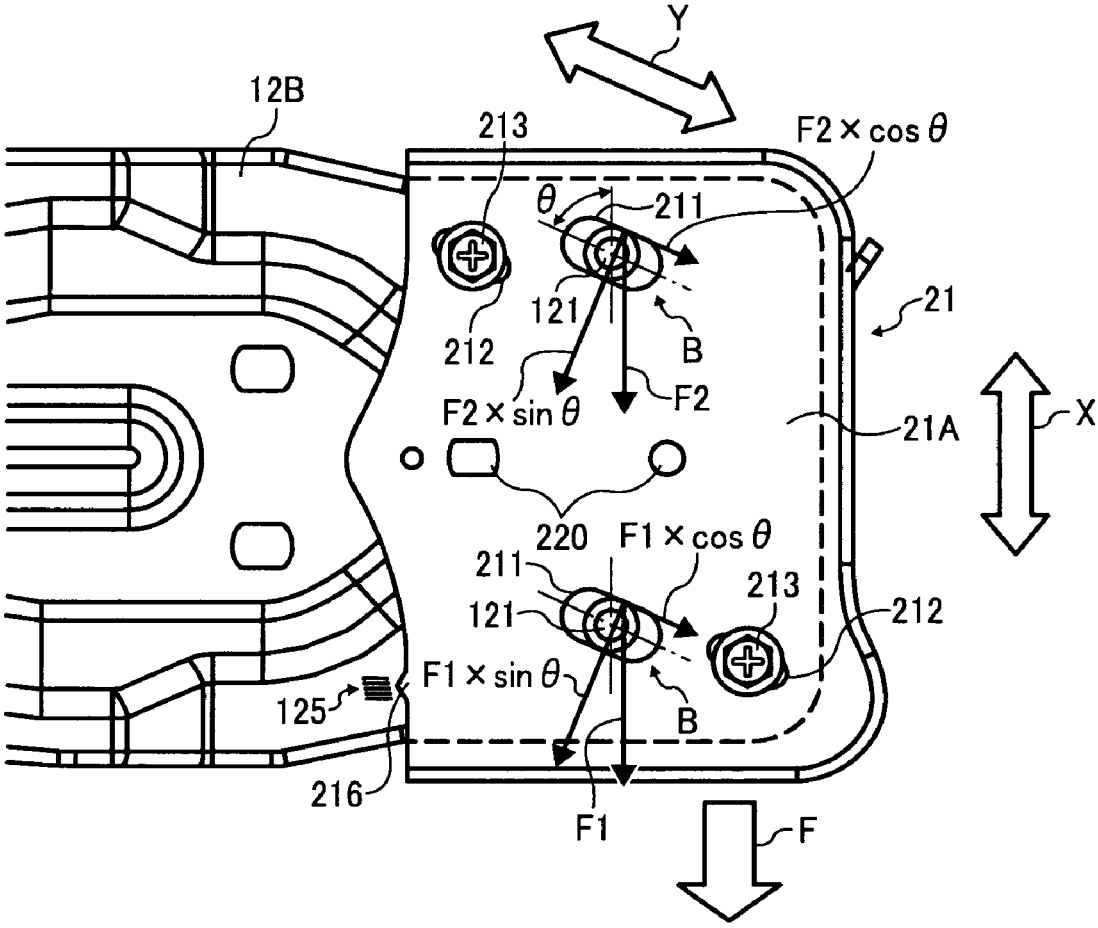
FIG. 8 is a schematic view of the adjuster and the cantilever support shown in FIG. 7 illustrating adjustment procedure.

Referring to FIGS. 6, 7, and 8, a description is now given of adjustment of a horizontal position of the scanner 30 using the cantilever support 12 and the adjuster 21.

FIG. 6 is a front view of the adjuster 21 and the scanner cantilever support 12. FIG. 7 is a perspective view of the adjuster 21 and the scanner cantilever support 12. FIG. 8 is a schematic view of the adjuster 21 and the scanner cantilever support 12 illustrating adjustment procedure.

As illustrated in FIG. 6, the adjuster 21 further includes a screw 213 and/or positioning holes 220. The slots 211 are obliquely provided in the plate-like portion 21A, and engage the protrusions 121 provided in the scanner cantilever support 12, respectively, forming an engagement portion B.

The second slot 212 inclines in a direction equal to that of the first slot 211. The scanner cantilever support 12 is fastened to the adjuster 21 using the screw 213 through the slot 212 and a screw hole provided in the scanner cantilever support 12.

The scanner mount 214 extends horizontally from the bottom rim 21D of the adjuster 21 to the inside of the frame structure A. The scanner positioner 215 extends from the front rim 21C to the inside of the frame structure A, and determines a proximal position of the scanner 30.

As illustrated in FIG. 6, the adjuster 21 is attached to the adjuster supporting portion 12C depicted in FIG. 3 of the scanner cantilever support 12 using the screws 213 inserted through the slots 212 and the screw hole in the scanner cantilever support 12, while the protrusions 121 engage the slots 211.

As illustrated in FIG. 8, the slot 211 inclines at an angle of θ with respect to a direction of adjustment of the scanner 30, that is, the vertical direction X. When the protrusions 121 are engaged in the slots 211, the adjuster 21 moves along a direction of inclination of the slots 211, thereby making it possible to slightly adjust the position of the adjuster 21 relative to the adjuster supporting portion 12C depicted in FIG. 4. Since the adjuster 21 moves in an oblique direction relative to the vertical direction, that is, in a direction indicated by the double-headed arrow Y, the amount of vertical movement of the adjuster 21 is smaller than the amount of oblique movement of the adjuster 21, and thus the adjuster 21 can slightly adjust the horizontal position of the scanner 30.

As illustrated in FIG. 1, a bottom surface of the scanner 30 placed on the frame body A is supported by each of the above surfaces of the scanner supports 10 and 11, and the scanner mount 24 provided at the edge of the scanner cantilever support 12 depicted in FIG. 3.

According to the example embodiment, the protrusions 121 are provided in the scanner cantilever support 12, as illustrated in FIG. 4, and the slots 211 are provided in the adjuster 21, as illustrated in FIG. 5. Alternatively, the protrusion 121 may be provided in the adjuster 21, and the slot 211 may be provided in the scanner cantilever support 12.

It is to be noted that although the adjuster 21 includes two engagement portions B, as illustrated in FIG. 6, the adjuster 21 may include one engagement portion B.

The horizontal positioning of the scanner 30 is described in greater detail with reference to FIG. 8. The scanner cantilever support 12 further includes a scale 125, and the adjuster 21 further includes a protruding portion 216. When the adjuster 21 is subject to an excessive load or impact in a downward vertical direction, for example, when a vertical load F is applied to the engagement portion B, the vertical load F is divided into a load F1 and a load F2, then, a relation between the vertical load F and the loads F1 and F2 is represented as F=F1+F2.

To be specific, the load F1 is divided into two forces acting in the oblique direction Y and in a direction perpendicular to the oblique direction Y. One force acting in the direction perpendicular to the oblique direction Y is represented as F1×sin θ. The other force acting in the oblique direction Y is represented as F1×cos θ.

As with the load F1, the load F2 is divided into two forces acting in the oblique direction Y and in a direction perpendicular to the oblique direction Y. One force acting in the direction perpendicular to the oblique direction Y is represented as F2×sin θ. The other force acting in the oblique direction Y is represented as F2×cos θ.

The engagement portions B receive the forces (F1×sin θ), (F2×sin θ) acting in the direction perpendicular to the oblique direction Y, respectively. When the scanner cantilever support 12 is fastened to the adjuster 21 via the screw 213, fastening force is generated between the scanner cantilever support 12 and the adjuster 21 to receive the forces (F1×cos θ), (F2×cos θ) acting in the oblique direction Y, thereby effectively reducing or preventing vertical movement of the adjuster 21. As a result, the scanner 30 can be kept level.

In addition, the adjuster 21 includes two or more engagement portions B connecting the scanner cantilever support 12 and the adjuster 21 to produce a relative movement between the scanner cantilever support 12 and the adjuster 21. Thus, the vertical load F applied to the adjuster 21 is divided into the loads F1 to Fn at each of the engagement portions B, that is, a relation between the vertical load F and the loads F1 to Fn may be represented as F=F1+F2+ . . . +Fn.

As a result, each of the engagement portions B is subjected to a decreased load, thereby effectively reducing or preventing vertical movement of the adjuster 21, so that the scanner 30 can be kept level. It is to be noted that the engagement portion B also functions as a guiding member for movement of the adjuster 21.

As illustrated in FIG. 1, the internal-discharge-type image forming apparatus 100 includes the discharge space open at a front side and one lateral side of the frame structure A, so as to facilitate removal of a discharged sheet.

According to the example embodiment, since a user can fasten the adjuster 21 to the scanner cantilever support 12 with the screw 213 from the lateral side of the frame structure A, when the user merely removes an exterior covering of the side of the adjuster 21, the user can easily handle the screw 213. In addition, setting a tightening direction of the screw 213 (a rotation direction of the screw 213) in a same direction facilitates maintenance of the image forming apparatus 100, thereby reducing time required for adjustment of the adjuster 21.

In addition, as illustrated in FIG. 8, the scale 125 is provided on an outer circumferential surface of the scanner cantilever support 12, and includes a plurality of graduation lines extending in parallel in a horizontal direction, equally separated from each other. The protruding portion 216 is provided at an edge of the plate-like portion 21A of the adjuster 21 to point the scale 125. Based on a relative position between the scale 125 and the protruding portion 216, the user can confirm a correct relative position of the adjuster 21 relative to the scanner cantilever support 12, an inclination angle of the adjuster 21 relative to the scanner cantilever support 12, and a degree of horizontality of the adjuster 21 relative to the scanner cantilever support 12.

Thus, the scale 125 and the protruding portion 216 serve as an adjuster position indicator.

It is to be noted that the scanner cantilever support 12 may include the protruding portion 216, and the adjuster 21 may include the scale 125.

Dimensioning error and assembly error occurring between the scanner supports 10 and 11 depicted in FIG. 2 and the scanner cantilever support 12 can cause a difference in height between each frame structure A (each image forming apparatus 100) mounting the scanner 30. To be specific, an error in dimensions of an upper surface of each of the scanner supports 10 and 11 and the scanner mount 214 of the adjuster 21 or an error in assembly thereof can cause variations in a horizontal position of the scanner 30 provided above the image forming apparatus 100.

Although the sizes of the scanner supports 10 and 11 and the scanner cantilever support 12 are different between each image forming apparatus 100, the scanner positioning mechanism 20, serving as a scanner arrangement jig, adjusts a default position of the adjuster 21, thereby slightly adjusting an installation angle of the scanner 30.

That is, the scanner supports 10 and 11 and the scanner positioning mechanism 20 including the scanner cantilever support 12 determine a position of the adjuster 21. Thus, a positioning pin provided in the scanner positioning mechanism 20 fits into the positioning hole 220 of the adjuster 21, such that the scanner 30 is positioned in the adjusted position, as indicated by a circle S as illustrated in FIG. 7.

Alternatively, the adjuster 21 presses against the scanner positioning mechanism 20, such that the scanner 30 is positioned in the adjusted position.

A conventional cantilever support tends to be deformed in a downward direction, when a user accidentally presses their hands on a scanner or places their elbow on the scanner to cause the scanner cantilever support to be subjected to an excessive load or impact in the downward direction. However, according to the example embodiment, as illustrated in FIG. 6, when the rims 21B, 21C, and 21D of the adjuster 21 contact an outer circumferential surface of an edge of the scanner cantilever support 12 to define upper and lower limits of an adjustment area, the following relation is obtained:

$$\alpha > \beta$$

where $\alpha$ represents an upward adjustable amount, and $\beta$ represents a downward adjustable amount.

Any method for controlling the upper and lower limits of the adjustment area may be used when the upward adjustable amount $\alpha$ is greater than the downward adjustable amount $\beta$.

It is to be noted that, as illustrated in FIG. 6, the slot 211 and the slot 212 may be provided in a different position from those as illustrated in FIG. 8.

According to the example embodiment, the frame structure A can be applied to an image forming apparatus for example, a copier, printer, facsimile, and the like including a scanner.

According to the example embodiment, the frame structure A includes the scanner supports 10 and 11 and the scanner cantilever support 12 supporting the scanner 30, and the scanner cantilever support 12 includes the protrusion 121 provided in the free end of the scanner cantilever support. 12 or in the adjuster 21. The protrusion is engageable with the inclined slot 211 to obliquely raise and lower the adjuster 21, thereby reducing and preventing misalignment or damage of the adjuster 21, so that the scanner 30 is properly maintained level. Even when the scanner cantilever support 12 is deformed, the adjustment of the horizontal position of the scanner 30 enables the scanner 30 to properly scan a document.

According to the example embodiment, the frame structure A includes two or more engagement portions B including the protrusion 121 and the slot 211, thereby reducing or preventing misalignment or damage of the adjuster 21, so that the scanner 30 can be easily and properly maintained level. Even when the scanner cantilever support 12 is deformed, the adjustment of the horizontal position of the scanner 30 enables the scanner 30 to properly scan a document.

According to the example embodiment, the frame structure A includes an adjuster position indicator, that is, the scale 125 and the protruding portion 216, indicating an amount of vertical movement of the adjuster 21 relative to the scanner cantilever support 12, so that a user can visually confirm the amount of vertical movement of the adjuster 21 relative to the scanner cantilever support 12, thereby reducing or preventing misalignment or damage of the adjuster 21. As a result, the scanner 30 is easily and properly maintained level. Even when the scanner cantilever support 12 is deformed, by adjusting the horizontal position of the scanner 30 while grasping the amount of movement of the adjuster 21, the scanner 30 can properly scan a document, so that the image forming apparatus 100 can perform robust and high-quality image formation.

According to the example embodiment, since the frame structure A includes a scanner arrangement jig, that is, the scanner positioning mechanism 20 depicted in FIG. 1, adjusting a horizontal position of the scanner 30 to determine a default position of the adjuster 21, even though the sizes of the scanner supports 10 and 11 and the scanner cantilever support 12 vary in each image forming apparatus 100, the scanner 30 is properly maintained level. Therefore, the scanner 30 properly scans a document, and the image forming apparatus 100 performs robust and high-quality image formation.

According to the example embodiment, since the upper adjustable amount $\alpha$ of the adjuster 21 is greater than the lower adjustable amount $\beta$ of the adjuster 21, the adjuster 21 can adjust a horizontal position of the scanner 30 for increased distance. Thus, the adjuster 21 can deal with accidental deformation of the scanner 30, thereby decreasing maintenance time required for replacement or the like of the scanner cantilever support 12. As a result, the rate of utilization of the image forming apparatus 100 does not decrease. In addition, running costs and maintenance costs do not increase and there is no impairing high-quality image formation.

According to the example embodiment, since the adjuster 21 is fastened to the scanner cantilever support 12 from outside of the frame structure A, a user can easily and properly make an adjustment to the adjuster 21 by merely removing an exterior covering of the image forming apparatus 100. Thus, the scanner 30 can properly scan a document, so that the image forming apparatus 100 can perform robust and high-quality image formation. In addition, maintenance time required for adjustment of the scanner cantilever support 12 decreases, thereby preventing a decrease in the rate of utilization of the image forming apparatus 100, as well as preventing an increase in running costs and maintenance costs.

According to the example embodiment, since the adjuster 21 of the scanner positioning mechanism type 20 has a simple configuration as described above with reference to FIG. 5, the adjuster 21 is easily attached to the scanner cantilever support 12 without spending much time, resulting in no increase in assembly costs and component costs.

The present invention has been described above with reference to specific example embodiments. Nonetheless, the present invention is not limited to the details of example embodiments described above, but various modifications and improvements are possible without departing from the spirit and scope of the present invention. The number, position, shape, and the like, of the above-described constituent elements are not limited to the above-described example embodiments, but may be modified to the number, position, shape, and the like, which are appropriate for carrying out the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A frame structure for supporting a scanner, comprising:

three or more supporting members provided vertically from a base portion;

a scanner support provided horizontally between upper portions of the supporting members;

a scanner cantilever support extending horizontally from the upper portion of one of the supporting members; and an adjuster attached to a free end of the scanner cantilever support, the adjuster comprising an inclined slot;

wherein the scanner cantilever support comprises a protrusion provided in the free end of the scanner cantilever support, and wherein the protrusion is engageable with the inclined slot of the adjuster to obliquely raise and lower the adjuster.

2. The frame structure according to claim 1, further comprising:

two or more engagement portions including the protrusion and the inclined slot.

3. The frame structure according to claim 1, further comprising:

an adjuster position indicator to indicate an amount of vertical movement of the adjuster relative to the scanner cantilever support.

4. The frame structure according to claim 1, wherein the scanner cantilever support and the adjuster serve as a scanner arrangement jig to adjust a horizontal position of the scanner.

5. The frame structure according to claim 1, wherein an upper adjustable area of the adjuster is greater than a lower adjustable area of the adjuster.

6. The frame structure according to claim 1, wherein the adjuster is fastened to the scanner cantilever support from outside of the frame structure.

7. The frame structure according to claim 1, wherein the scanner cantilever support and the adjuster serve as a scanner arrangement jig to adjust a default position of the adjuster.

8. The frame structure according to claim 1, wherein the scanner cantilever support and the adjuster serve as a scanner arrangement jig to adjust a vertical position of the scanner.

9. The frame structure according to claim 1, wherein the protrusion is engageable with the inclined slot of the adjuster to obliquely raise and lower the adjuster over a continuous interval corresponding to the inclined slot.

10. The frame structure according to claim 1, wherein the scanner cantilever support further comprises multiple protrusions, wherein the adjuster further comprises multiple inclined slots, and wherein the multiple inclined slots are inclined at a same angle.

11. An image forming apparatus, comprising:

a frame structure to support a scanner, comprising:

three or more supporting members provided vertically from a base portion;

a scanner support provided horizontally between upper portions of the supporting members;

a scanner cantilever support extending horizontally from the upper portion of one of the supporting members; and an adjuster attached to a free end of the scanner cantilever support, the adjuster comprising an inclined slot;

wherein the scanner cantilever support comprises a protrusion provided in the free end of the scanner cantilever support, and wherein the protrusion is engageable with the inclined slot of the adjuster to obliquely raise and lower the adjuster.

12. The image forming apparatus according to claim 11, wherein the scanner cantilever support and the adjuster serve as a scanner arrangement jig to adjust a horizontal position of the scanner, a vertical position of the scanner, or the horizontal and vertical positions of the scanner.

13. The image forming apparatus according to claim 11, wherein the scanner cantilever support further comprises multiple protrusions, wherein the adjuster further comprises multiple inclined slots, and wherein the multiple inclined slots are inclined at a same angle.

* * * * *